US007125203B1

(12) United States Patent
Evans

(10) Patent No.: US 7,125,203 B1
(45) **Date of Patent: *Oct. 24, 2006**

(54) RETAINING WALL AND BLOCK

(75) Inventor: M. Todd Evans, Winston Salem, NC (US)

(73) Assignee: Mary L. Evans, Ararat, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/117,033

(22) Filed: Apr. 28, 2005

Related U.S. Application Data

(63) Continuation of application No. 10/640,485, filed on Aug. 13, 2003, now abandoned.

(51) Int. Cl.
*E02D 29/02* (2006.01)

(52) U.S. Cl. ..... 405/286; 405/284; 52/302.4; 52/604; 52/605; D25/113

(58) Field of Classification Search ..... 52/603, 52/604, 605, 302.4, 314; 405/284, 286; D25/113

See application file for complete search history.

(56) References Cited

U.S. PATENT DOCUMENTS

| | | | | | |
|---|---|---|---|---|---|
| 314,022 | A | * | 3/1885 | Heard | 52/605 |
| 1,992,785 | A | * | 2/1935 | Steuer | 52/564 |
| 2,141,035 | A | * | 12/1938 | Daniels | 202/223 |
| 4,920,712 | A | * | 5/1990 | Dean, Jr. | 405/286 |
| 4,965,979 | A | * | 10/1990 | Larrivee et al. | 52/592.6 |
| 5,421,135 | A | * | 6/1995 | Stevens et al. | 52/604 |
| D362,511 | S | * | 9/1995 | Anderson et al. | D25/113 |
| 5,505,034 | A | * | 4/1996 | Dueck | 52/604 |
| 5,537,796 | A | * | 7/1996 | Kliethermes, Jr. | 52/592.6 |
| 5,651,642 | A | * | 7/1997 | Kelley et al. | 405/286 |
| 5,941,042 | A | * | 8/1999 | Dueck | 52/604 |
| D435,302 | S | * | 12/2000 | Blomquist et al. | D25/113 |
| D466,229 | S | * | 11/2002 | Risi et al. | D25/113 |
| D466,619 | S | * | 12/2002 | Britton | D25/113 |
| D467,009 | S | * | 12/2002 | Agee | D25/113 |
| D468,449 | S | * | 1/2003 | Britton | D25/113 |
| D477,419 | S | * | 7/2003 | Manthei | D25/113 |
| D485,371 | S | * | 1/2004 | Burgess et al. | D25/113 |
| 6,715,965 | B1 | * | 4/2004 | Manthei et al. | 405/284 |
| D500,864 | S | * | 1/2005 | Klettenberg et al. | D25/113 |
| 6,871,468 | B1 | * | 3/2005 | Whitson | 52/592.6 |
| D511,846 | S | * | 11/2005 | Evans | D25/113 |

(Continued)

OTHER PUBLICATIONS

Photos 1, 2 and 3 show typical wall facings formed of concrete which can be purchased from local building supply stores. These facings are approximately 1-2 inches thick and provide a "layered" appearance. These facings are not wall blocks but are applied to single block walls for decorative purposes.

*Primary Examiner*—Robert Canfield

(57) ABSTRACT

A retaining wall and block are described herein for use in landscaping, gardening and the like. The block is formed from concrete and has an uneven face to replicate layers of flat stone. An elongated groove in the top of each block provides for reception of mating studs of upper contiguous blocks. The elongated groove is sized to allow the blocks to be turned and moved depending on the type and design of the particular wall being constructed. The ends of the blocks are biased to allow easy rotation and placement when building a curved or circular wall. A filler is provided for placement within the elongated groove of the blocks in the top tier of the retaining wall to provide for a smooth, flush surface.

19 Claims, 2 Drawing Sheets

U.S. PATENT DOCUMENTS

2002/0028114 A1* 3/2002 Whitson ..... 405/284
2002/0059769 A1* 5/2002 Matsuda ..... 52/605
2003/0213203 A1* 11/2003 Bott et al. ..... 52/603

* cited by examiner

RETAINING WALL AND BLOCK

This is a continuation of application Ser. No. 10/640,485 filed 13 Aug. 2003, now abandoned.

FIELD OF THE INVENTION

The invention herein pertains to concrete construction blocks and particularly pertains to blocks which are used to form retaining walls in yards, gardens, terraces and the like.

DESCRIPTION OF THE PRIOR ART AND OBJECTIVES OF THE INVENTION

Various shapes and styles of concrete and other blocks have been used in the past to form retaining walls used in landscaping, garden perimeters and for other uses. Prior blocks include rear bottom lips which assist in the uniform alignment of the blocks during wall formation. However the lips limit the ability of the blocks to be turned such as while forming a round or circular wall. Certain of the prior art retaining wall blocks have smooth top and bottom surfaces which prevent the blocks from maintaining their position when subjected to forces from settling dirt, water seepage and earth movement. Other prior art blocks have decorative, uneven faces.

Based on the disadvantages and problems associated with such prior retaining wall blocks and walls formed therewith the present invention was conceived and one of its objectives is to provide a retaining wall block which can be easily used in the construction of a retaining wall irrespective of whether the wall is straight or circular.

It is still another objective of the present invention to provide a retaining wall block which can be easily used in construction of a "stair-step" type retaining wall.

It is another objective of the present invention to provide a retaining wall having blocks which interlock between tiers and yet which blocks can be modified with a filler to provide a smooth attractive top surface for the top wall tier.

It is a further objective of the present invention to provide a retaining wall block which can be matingly engaged with a contiguous block of another tier.

It is also an objective of the present invention to provide a retaining wall block having a pair of bottom mating studs and an elongated top groove.

It is yet another objective of the present invention to provide a retaining wall block having an uneven face which replicates multi-layers of flat stone.

It is also an objective of the present invention to provide a retaining wall formed from multiple tiers of wall blocks as described herein.

Various other objectives and advantages of the present invention will become apparent to those skilled in the art as a more detailed description is set forth below.

SUMMARY OF THE INVENTION

The aforesaid and other objectives are realized by providing a retaining wall block molded from concrete which includes an elongated top groove. The elongated groove communicates with a drainage opening, also in the top of the block to allow any water or moisture collected to quickly drain rearwardly therefrom. The bottom of the block includes a pair of conically shaped mating studs which are sized to loosely fit within the elongated groove of an adjacent block. The mating studs are sized whereby each of the stacked blocks can be easily rotated or moved to a desired position such as when forming either a straight or arcuate wall. The outer surfaces of the mating studs are slanted at approximately eighteen (18) degrees to complement the slanted wall of the elongated groove. The excess size of the elongated groove relative to the mating studs also allows the wall to be constructed in either a stair-step style or with a vertical face.

The blocks are molded in an isosceles trapezium shape to allow rotation of the blocks during wall formation such as when building a circular wall. To enhance the appearance of the retaining wall, fillers are formed of concrete to fit flush within the top elongated grooves to provide the top tier of the wall with a smooth, attractive appearance.

DETAILED DESCRIPTION OF THE PREFERRED EMBODIMENTS AND OPERATION OF THE INVENTION

Figure 1:
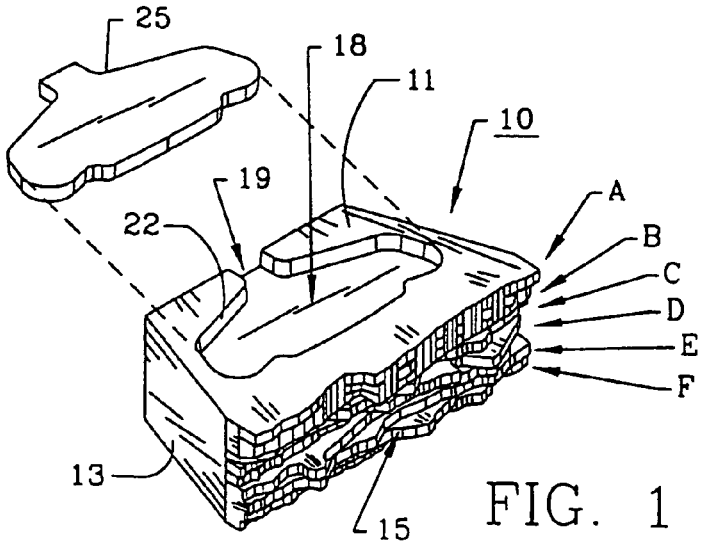
FIG. 1 illustrates a top left side front view of the preferred block of the invention with the filler exploded therefrom.
Figure 3:
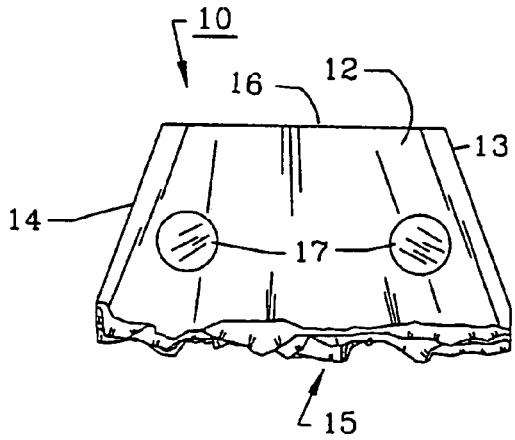
FIG. 3 features a bottom view of the block as shown in FIG. 1.

For a better understanding of the invention and its operation, turning now to the drawings, FIG. 1 demonstrates preferred retaining wall block 10 preferably formed by the conventional molding of concrete. Block 10 includes top 11, bottom 12 as shown in FIG. 3 with biased sides 13, 14, front or face 15 and back 16. Irregular face 15 is cast or molded to replicate layers of natural flat rock. Block 10 has preferably, approximately six (6) layers A–F as further seen in FIG. 1 although more or less layers may be desirable. Block 10 has preferably a length approximately of thirteen and one-half (13.5) inches (34.29 cm), a depth of eight (8) inches (20.32 cm), a height of four (4) inches (10.16 cm) and has a weight of approximately twelve (12) pounds (5.44 kg).

Figure 2:
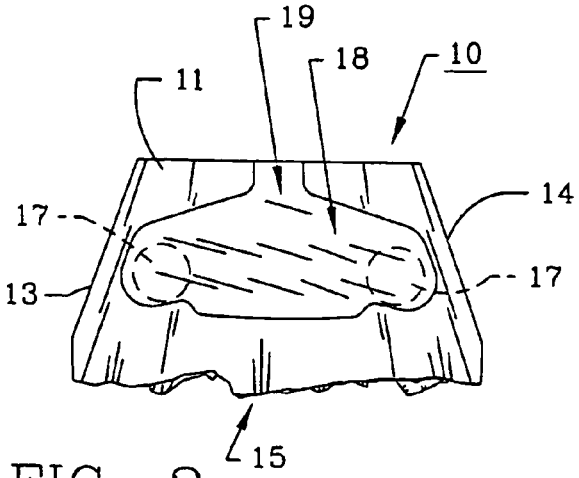
FIG. 2 shows a top view of the block as seen in FIG. 1 with mating studs of a block stacked thereon shown in ghost form.

Elongated groove 18 as shown in FIGS. 1 and 2 extends almost the entire length of block 10 along top 11 and communicates with drainage opening 19. As would be understood, moisture, rain water or the like which is collected in groove 18 will exit drainage opening 19 at the top rear of block 10. Elongated groove 18 has a depth preferably of 1.58 cm and filler 25 shown in FIG. 1 has a height of approximately 1.58 cm and is placed in groove 18 in the top tier of a retaining wall such as tier 31 in retaining wall 30 shown in FIG. 4 to provide a finished appearance.

Five (5) tiers 31–35 are shown formed from block 10 in wall 30 although more or less tiers may be built as needed. Tier 31, would therefore utilize fillers 25 to provide a smooth, flush, finished appearance to the top of retaining wall 30 as seen in the top perspective view of wall 30 in FIG. 5.

Figure 4:
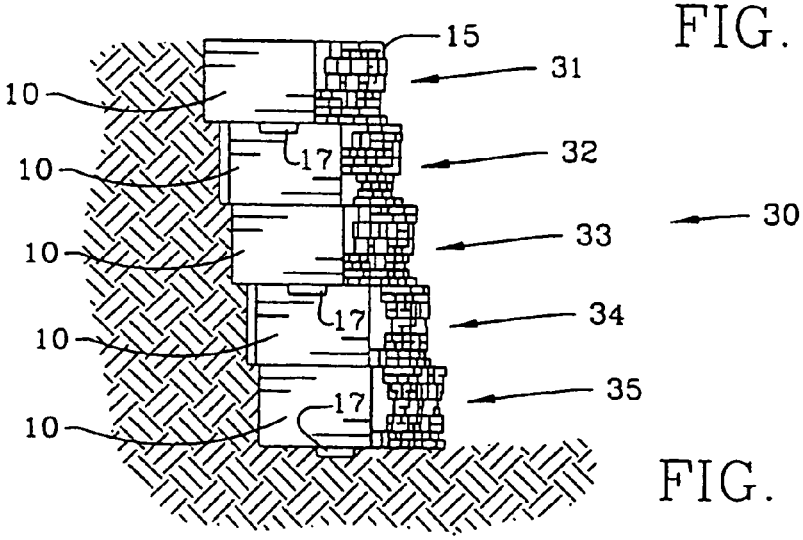
FIG. 4 demonstrates an end view of a typical retaining wall formed from the block as seen in FIG. 1.

In FIG. 4, retaining wall 30 is shown formed in a standard "stair-step" configuration. However, blocks 10 could also be set straight with a vertical wall face or with other alignment.

Figure 5:
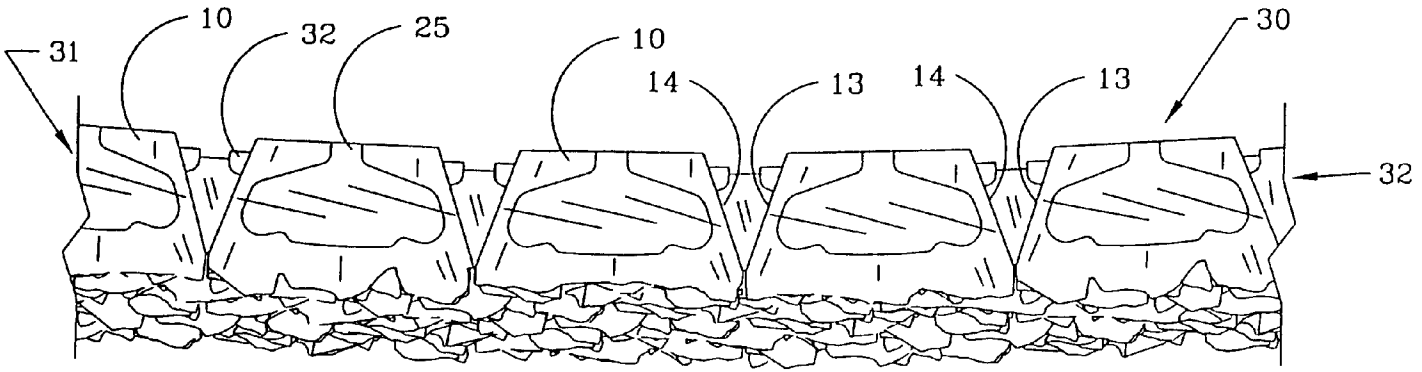
FIG. 5 depicts a somewhat top perspective view of two tiers of a typical arcuate retaining wall.

In FIG. 5 retaining wall 30 is seen with a slight frontal arc but could have a linear front instead or could be curved at a sharper arc, depending on the builder's or mason's selection. Wall curvature is available due in part to the bias of block ends 13, 14 as shown in FIGS. 2, 3 and 5. Ends 13, 14 of block 10 are biased at approximately thirty-five (35°) degrees to provide an isosceles trapezium shape to block 10 which allows for easy horizontal rotation and wall curvature.

To stabilize retaining wall 30, mating studs 17 are affixed as by integrally forming or molding to bottom 12 of block 10 as shown in FIG. 3. Mating studs 17 are conically shaped with preferably a round cross-section and extend slightly less than ⅝ of an inch (1.58 cm) to properly fit within elongated grooves 18. The outer surface of mating stud 17 has a vertical slant of approximately eighteen (18°) degrees as does groove wall face 22 (FIG. 1) of groove 18.

Figure 6:
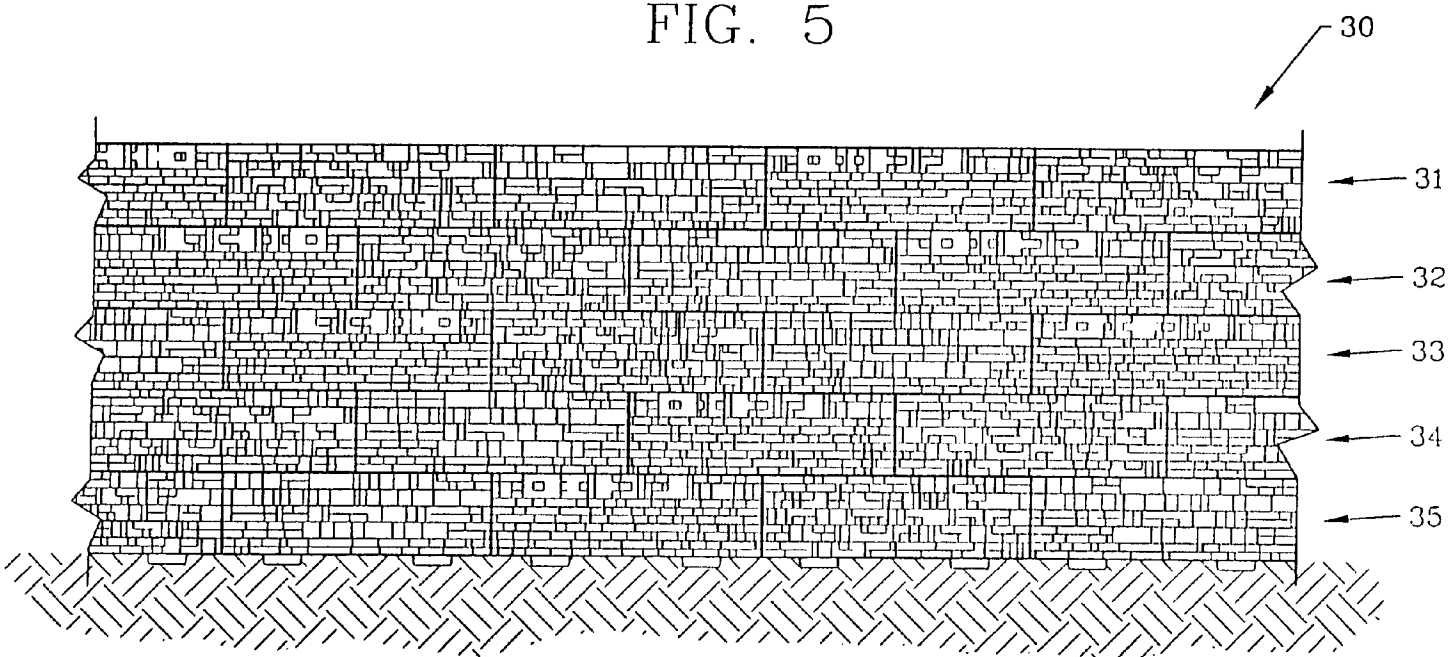
FIG. 6 shows a front elevational view of a section of a typical retaining wall as formed from the block as seen in FIG. 1.

Mating studs 17 in FIG. 2 are shown in broken line form to show their relative small size compared to the size (area) of elongated groove 18. Blocks 18 can be vertically mated in any of a variety of desired positions and when stacked, such as in arcuate wall 30 in FIGS. 5 and 6. Blocks 10 can also be stacked to form a straight wall, form a wall having stair-step tiers or form a wall with a flush face (not shown). In addition, the large excessive size of elongated groove 18 allows block 10 to be easily moved and rotated during wall construction to obtain the desired position of each block 10, even while blocks 10 are mated or stacked. This assists in wall construction as irregularities often occur due to trees, rocks or other natural or man-made boundaries which may be encountered. Freedom to turn or rotate blocks 10 horizontally can be very advantageous and eliminate the need for laboriously cutting or altering of blocks 10.

The illustrations and examples provided herein are for explanatory purposes and are not intended to limit the scope of the appended claims.

I claim:

1. A retaining wall block comprising:

a body, said body comprising a front, a back, a top, a bottom and a pair of ends, said front wider than said back, said top defining an elongated groove and a drainage opening, said drainage opening in fluid communication with said groove proximate said back for drainage of said top from said front to said back, a pair of mating studs, said mating studs attached to said bottom, whereby said retaining wall block can be used as a lower block in a multi-tiered wall with said groove sized to allow the mating studs of a contiguous upper block to mate therewith and to rotate and move in any horizontal direction for selectively offsetting the upper block.

2. The retaining wall block of claim 1 wherein said upper block is similar to said lower block and said mating studs of said upper block are sized to loosely fit within said groove of said lower block.

3. The retaining wall block of claim 1 wherein said front comprises a horizontal layered appearance.

4. The retaining wall block of claim 1 wherein one of said mating studs has a conical shape.

5. The retaining wall block of claim 1 wherein said pair of mating studs each have a length no longer than the depth of said elongated groove.

6. The retaining wall block of claim 1 formed from concrete.

7. The retaining wall block of claim 1 wherein said elongated groove has a depth of approximately 0.625 inches.

8. The retaining wall block of claim 1 wherein said ends are convergently biased.

9. The retaining wall block of claim 1 wherein each of said ends is biased approximately thirty-five degrees (35°).

10. The retaining wall block of claim 1 wherein said front defines an irregular face.

11. The retaining wall block of claim 1 further comprising a filler, said filler positioned in said elongated groove.

12. A rigid retaining wall block comprising: a back, a top, said top defining an elongated groove and a drainage opening, said drainage opening in fluid communication with said groove proximate said back, a bottom, a pair of mating studs, said mating studs spaced along said bottom, a face, said face defining a plurality of multi-layers, said face wider than said back, said groove sized to allow one or more contiguous similar blocks to mate thereon and to selectively rotate and move in any horizontal direction while mated.

13. The retaining wall block of claim 12 wherein said mating studs each define a vertical slant of approximately eighteen degrees (18°).

14. The retaining wall block of claim 12 wherein said block further defines a pair of ends, each of said ends biased approximately thirty-five degrees (35°) whereby said block has a trapezium shape.

15. The retaining wall block of claim 12 wherein said top defines an outer groove wall slanted approximately eighteen degrees (18°).

16. The retaining wall block of claim 12 wherein each of said mating studs is conically shaped.

17. A retaining wall comprising a plurality of tiers of rigid wall blocks, said tiers comprising a top tier, said wall blocks matingly engaged, each of said blocks selectively rotatable and selectively moveable in any horizontal direction during engagement with contiguous blocks wherein each of the said wall blocks comprises a top, a front, a back, said top defining an elongated groove and a drainage opening, and said groove in fluid communication with said drainage opening proximate said back whereby drainage moves backwardly from said front to said back.

18. The retaining wall of claim 17 wherein each of said blocks comprises a pair of conically shaped mating studs.

19. The retaining wall of claim 17 further comprising a plurality of fillers, said fillers positioned in said elongated grooves of said wall blocks of said top tier.

* * * * *